US011148768B2

(12) United States Patent
Spardel

(10) Patent No.: US 11,148,768 B2
(45) Date of Patent: Oct. 19, 2021

(54) ACTIVE STABILIZING DEVICE AND METHOD

(71) Applicant: SKF MARINE GMBH, Hamburg (DE)

(72) Inventor: Holger Spardel, Hamburg (DE)

(73) Assignee: SKF MARINE GMBH, Hamburg (DE)

( * ) Notice: Subject to any disclaimer, the term of this patent is extended or adjusted under 35 U.S.C. 154(b) by 0 days.

(21) Appl. No.: 16/778,387

(22) Filed: Jan. 31, 2020

(65) Prior Publication Data

US 2020/0247510 A1 Aug. 6, 2020

(30) Foreign Application Priority Data

Feb. 6, 2019 (DE) ..... 102019201501.8

(51) Int. Cl.
*B63B 39/06* (2006.01)
*B63B 1/22* (2006.01)
*B63B 1/28* (2006.01)

(52) U.S. Cl.
CPC ..... *B63B 39/06* (2013.01); *B63B 1/22* (2013.01); *B63B 1/285* (2013.01)

(58) Field of Classification Search
CPC .... B63B 1/00; B63B 1/16; B63B 1/18; B63B 1/22; B63B 1/24; B63B 1/242; B63B 1/248; B63B 1/26; B63B 1/28; B63B 2001/281; B63B 1/285; B63B 1/286; B63B 1/30; B63B 2001/235; B63B 39/00; B63B 39/06
USPC ..... 114/122, 126, 271, 274, 275–280, 284
See application file for complete search history.

(56) References Cited

U.S. PATENT DOCUMENTS 3,793,973 A * 2/1974 Patterson ..... B63B 39/062 114/39.24
4,273,063 A * 6/1981 Berne ..... B63B 39/06 114/126
5,054,410 A * 10/1991 Scarborough ..... B63B 1/285 114/39.26

(Continued)

FOREIGN PATENT DOCUMENTS

EP 1498348 B1 9/2007
EP 2910463 B1 1/2017

(Continued)

OTHER PUBLICATIONS

"DYNA-FOIL: The new stabilizer system from Quantum"; Quantum, The Art of Stabilization; Ft. Lauderdale, Florida, USA; wwww.quantumhydraulic.com 2017.

(Continued)

*Primary Examiner* — Daniel V Venne
(74) *Attorney, Agent, or Firm* — J-TEK Law PLLC; Scott T. Wakeman; Mark A. Ussai

(57) ABSTRACT

An active stabilizing device for a primary damping of rolling movements of a ship or other watercraft including a hull including at least one positioning device having a drive journal and a stabilizing fin with a stabilizing surface and a root, the drive journal being attached to the stabilizing fin at the root, the stabilizing surface having a leading edge and a trailing edge and being configured to be disposed underwater. The positioning device is configured to set an angle of attack of the stabilizing fin by rotating the drive journal about a first axis of rotation and to pivot the drive journal about a second axis of rotation to move the stabilizing fin between a forward position and a rearward position relative to a bow of the watercraft.

12 Claims, 2 Drawing Sheets

(56) References Cited

U.S. PATENT DOCUMENTS

| | | | | |
|---|---|---|---|---|
| 6,227,139 | B1 * | 5/2001 | Nguyen | B63B 1/286 114/280 |
| 2004/0011269 | A1 * | 1/2004 | Echenique Gordillo | B63B 39/06 114/274 |
| 2015/0259052 | A1 * | 9/2015 | Skauen | B63B 39/06 114/126 |
| 2016/0059941 | A1 * | 3/2016 | Buechler | B63B 39/061 114/280 |
| 2018/0057125 | A1 | 3/2018 | Fournier | |
| 2019/0202535 | A1 * | 7/2019 | Skauen | F16H 1/10 |

FOREIGN PATENT DOCUMENTS

| | | | |
|---|---|---|---|
| GB | 2550123 | A | 11/2017 |
| WO | 2013095097 | A1 | 6/2013 |
| WO | 2017018877 | A1 | 2/2017 |
| WO | 2017074181 | A1 | 5/2017 |
| WO | 2017119008 | A1 | 7/2017 |

OTHER PUBLICATIONS

European Search Report from the European Patent Office dated Jul. 2, 2020 in related application No. EP 20 15 4921, including European Search Opinion.

* cited by examiner

ACTIVE STABILIZING DEVICE AND METHOD

CROSS-REFERENCE

This application claims priority to German patent application no. 10 2019 201 501.8 filed on Feb. 6, 2019, the contents of which are fully incorporated herein by reference.

TECHNOLOGICAL FIELD

The disclosure is directed to an active stabilizing device for primary damping of rolling movements of a ship or other watercraft having a hull. The stabilizing device includes at least one positioning device having a drive journal and including a stabilizing surface (on a stabilizer fin, for example) attached to the drive journal in the region of its root. The stabilizing surface includes a leading edge and a trailing edge, and is configured to be disposed under water. In addition the disclosure includes a method for operating an active stabilizing device for primary damping of rolling movements of a ship or other watercraft having a hull when the watercraft is not moving through the water or is moving through the water at a very low speed.

BACKGROUND

It is known to use active stabilizing devices, such as fin stabilizers attached to a hull of a watercraft below the waterline, in order to reduce or damp undesirable rolling movements of the watercraft.

When a watercraft moves through the water at a sufficient speed, damping can be achieved by changing the angle of attack of the fin stabilizer using suitable actuators. In their use position, the fins project outward from the watercraft and generate hydrodynamic forces that counteract the rolling movements.

If the case watercraft is not moving through the water or is moving very slowly, movement of water past the stabilizer fins does not create sufficient hydrodynamic forces to counteract rolling movements. Instead, under these conditions, the fin stabilizers must be moved back and forth through the water using further actuators at sufficient speed with a slightly changed angle of attack at least in the end positions of the pivot movement in order to build up the hydrodynamic forces required for counteracting the undesirable rolling movements of the watercraft. A further possibility is to vary the angle of attack of the stabilizing surface at high speed with constant pivoting angle in order to generate by such a paddle movement the mechanical forces required for stabilizing the hull against rolling movements.

It is disadvantageous that a leading edge of a flow profile of the stabilizing fins is flowed-against by the water in a pivoting direction as provided, but in the pivoting direction opposite thereto the trailing edge is exposed to the inflow of the water. Consequently due to the stabilizing fins periodically pivoting in opposite directions a significantly increased flow resistance arises that impairs the energetic efficiency of the entire stabilizing device.

SUMMARY

One aspect of the disclosure is to increase the energetic efficiency of a stabilizing device for damping rolling movements of a ship or other watercraft. In addition, the disclosure includes an optimized method for operating such a stabilizing device.

These aspects are achieved by a stabilizing device having a stabilizing surface, the angle of attach of which is specifiable by a positioning device, is pivotable by the positioning device about a pivot axis between a first and a second position, and is rotatable by the positioning device about an axis of rotation. Consequently with the active stabilizing device and watercraft not moving through the water, the stabilizing surface can be rotated about the axis of rotation such that, independently of the current direction of movement of the stabilizing surface, the leading edge is always flowed-against by the water. In this way the flow resistance of the stabilizing surface periodically pivoted back and forth when the watercraft is not moving through the water is reduced, and as a result the efficiency of the stabilizing device can be significantly increased. Here the free end of the stabilizing surface can follow, for example, a trajectory that is approximately rectangular or corresponds to an eight on its side or the infinity sign.

Using the positioning device the stabilizing surface is rotatable by approximately half a rotation. The stabilizing surface is rotatable, in particular using the positioning device, such that the leading edge of the stabilizing surface located under water preferably always remains essentially directed in the respective current pivot direction of the stabilizing surface.

The stabilizing surface is preferably rotatable about the axis of rotation by at least half a rotation.

Consequently the stabilizing surface can always be turned such that the leading edge is flowed-against by water, and the flow resistance and associated energy demand of the stabilizing device is reduced.

In the case of one refinement a radius of curvature of the leading edge is dimensioned to form an inflow nose larger than a radius of curvature of the trailing edge.

An optimal hydrodynamic profile thereby results for the stabilizing surface.

Preferably in the region of the drive journal a non-co-rotating inflow body is disposed at least flow-edge-side, which non-co-rotating inflow body is located between the first and second position of the stabilizing surface at least partially outside the hull. Due to the inflow body, functioning as a spoiler, the flow properties in the region of the drive journal can be optimized, since the hydrodynamic properties in the region of the drive journal are matched to those of the stabilizing surface.

In a technically advantageous design the inflow body is oriented essentially parallel to the hull longitudinal axis.

Consequently an increase of resistance during pivoting of the stabilizing surface can be avoided to the greatest possible extent. In addition the generation of dynamic uplift forces is counteracted by the inflow body.

In the case of a further design a cross-sectional geometry of the inflow body in a connecting region corresponds essentially to a cross-sectional geometry of the stabilizing surface in the vicinity of the hull.

Turbulent currents and eddies are thereby reduced in a connecting region between the inflow body and the stabilizing surface which stabilizing surface is preferably simultaneously rotatable about its axis of rotation.

In one favorable refinement the hull includes at least one receiving pocket for preferably complete receiving of each associated stabilizing surface. Consequently when the stabilizing device is not in use, in the ideal case the at least one stabilizing surface can be completely received in the associated receiving pocket to minimize the flow resistance of the hull.

In addition, the above-mentioned object is achieved by a method including the following characterizing steps:

a) periodic pivoting of the at least one stabilizing surface, adjusted by an angle of attack specified by a positioning device, about a pivot axis up to reaching a first or a second position, and b) with reversing of a pivoting direction of the stabilizing surface, twisting of the stabilizing surface by the positioning device about an axis of rotation such that preferably the leading edge of the stabilizing surface located under water always remains essentially directed in the respective current pivoting direction of the stabilizing surface.

Consequently in the case of a watercraft not moving through the water the efficiency of the stabilizing device can be significantly increased, since due to the leading edge always being oriented in the pivot direction the flow resistance of the stabilizing surface is reduced.

In one refinement of the method it is provided that using the positioning device the at least one stabilizing surface is pivoted between the first and second position about the pivot axis by a pivot angle of up to +60 degrees.

Due to the pivot angle of ±60° or 120° with respect to a central position of the stabilizing surface, wherein the stabilizing surface projects approximately at right angles from the hull of the watercraft or of the ship, an optimal damping of undesirable rolling movements of the watercraft is ensured. A maximum pivot angle of the stabilizing surface about the pivot axis is up to 160° with respect to a rest position of the stabilizing surface inside the receiving pocket in the hull of the ship and a first, maximally-pivoted-out-rearward position of the stabilizing surface.

According to one advantageous refinement of the method the angle of attack of the at least one stabilizing surface is varied using the positioning device in a range between ±60°. Due to the variation of the angle of attack of the stabilizing surface by ±60° or 120°, a further efficiency increase of the stabilizing effect can be achieved.

In the case of a preferred further development of the method, to set a rest position in the inactive state of the stabilizing device the at least one stabilizing surface is pivoted by the positioning device so far that the stabilizing surface is preferably completely received in a receiving pocket of the hull.

Consequently an increase of the flow resistance of the hull of the watercraft or of the ship due to the stabilizing device is avoided to the greatest possible extent. In the rest position of the stabilizing surface there is an angle of approximately 0° between the axis of rotation of the stabilizing surface and the hull longitudinal axis, i.e., they extend approximately parallel to each other. Starting from the rest position of the stabilizing surface inside the receiving pocket, the stabilizing surface can be pivoted using the positioning device by up to about 160° up to reaching the first, maximally rearward position.

In the following a preferred exemplary embodiment of the invention is explained in more detail with reference to schematic Figures.

DETAILED DESCRIPTION

Figure 1:
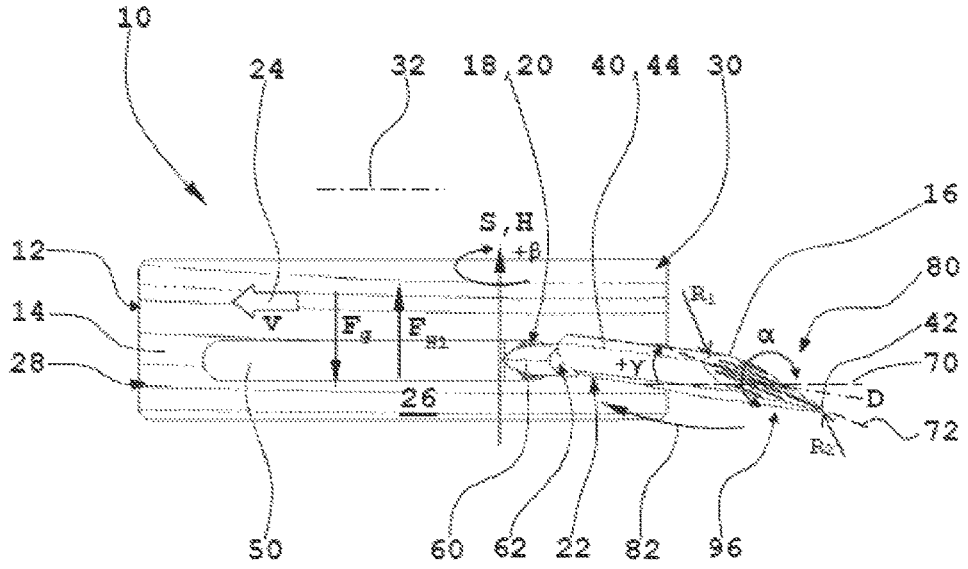
FIGS. 1-3 are perspective schematic views of a stabilizing surface of a stabilizing device in a first pivot direction in each of three different positions.
Figure 2:
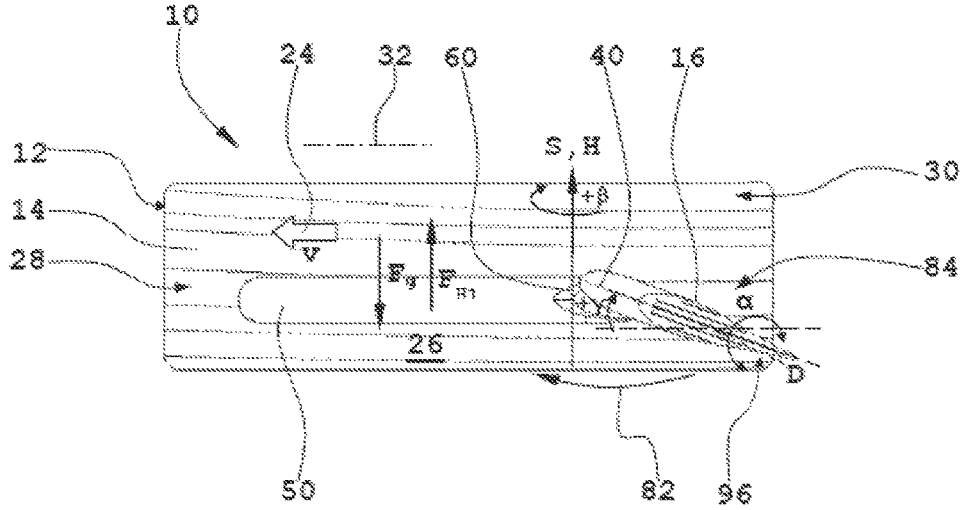
Figure 3:
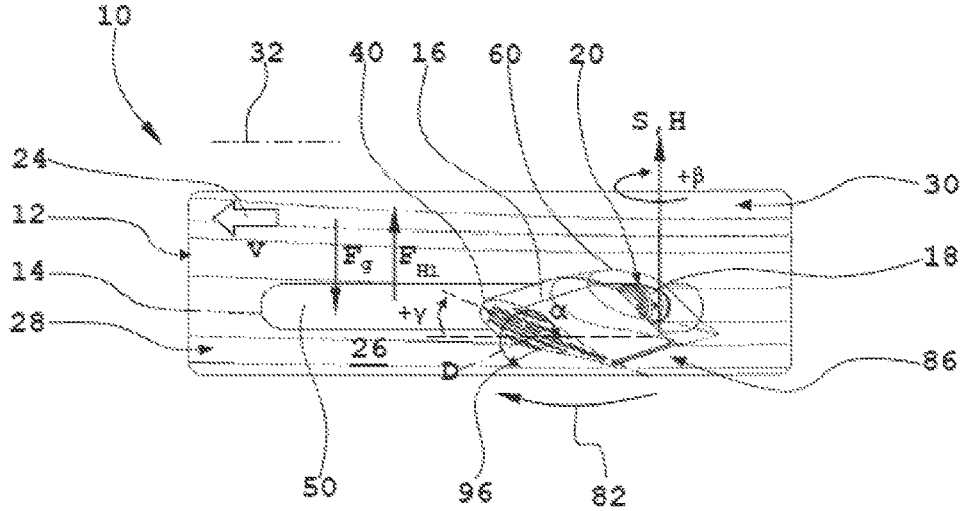

FIGS. 1 to 3—which are referred to together in the further course of the description—are perspective schematic views of a stabilizing surface of a stabilizing device in a first pivot direction in each of three different positions.

A watercraft or a ship 12 includes a conventional hull 14. For the predominant weakening of undesirable rolling movements an active stabilizing device 10 is integrated in the hull 14. Here the stabilizing device 10 includes, for example, a stabilizing surface 16 that is approximately rectangular and fin-like. If necessary the stabilizing surface 16 can also exhibit a peripheral contour of a polygon having more than four corners. The stabilizing surface 16 is pivotable about a pivot axis S and rotatable about an axis of rotation D using a suitable, preferably powerful, hydraulic positioning device 18 including a drive journal 20. In the region of its root 22 the stabilizing surface 16 is connected to the drive journal 20, preferably in a straight-line manner. An angled attaching of the stabilizing surface 16 to the drive journal 20 by, for example, 15° or more is also possible in individual cases.

Merely by way of example the ship 12 moves here through the water 26 in a preferred direction of the arrow 24. The stabilizing device 10 is activated when a speed v of the ship 12 through the water 26 is practically zero, or relatively low in relation to normal travel or cruising speed of the ship 12, which is synonymous with a speed v of up to 4 knots. In accordance with the preferred direction of travel through the water 26, the hull 14 of the ship 12 includes a bow 28 and a stern 30 advantageously formed in terms of fluid flow.

The hull 14 of the ship 12 is in general configured mirror-symmetric with respect to a hull longitudinal axis 32, that is, in addition to the stabilizing device 10 only schematically depicted here the hull 14 of the ship 12 preferably includes a further starboard-side stabilizing device formed mirror-symmetric with respect to the stabilizing device 10, but not depicted in drawing. Here the term "starboard side" means rightward in the direction of travel of the ship 12, while "port side" means leftward in the direction of travel of the ship 12. In the normal operating state of the ship 12 at least the stabilizing surface 16 of the stabilizing device 10 is always located completely under water 26.

Here the pivot axis S coincides merely by way of example with a vertical axis H (so-called yaw axis) of an orthogonal coordinate system 32 of the hull 14, the vertical axis H being oriented essentially parallel to the force of gravity $F_G$ when the hull is not heeling, i.e., is lying level in the water 26. Varying from this the pivot axis S of the stabilizing surface 16 can optionally extend at an angle (not illustrated) inclined up to 45° with respect to the vertical axis H of the rectangular coordinate system 32. The pivot movements of the stabilizing surface 16 by the positioning device 18 occur about the pivot axis S by a pivot angle +μ, while if necessary rotational movements or changes of an angle of attack γ of the stabilizing surface 16 are also performed about the axis of rotation D.

Here the axis of rotation D extends, for example, parallel with respect to a leading edge 40 and a trailing edge 42 of the stabilizing surface 16. Varying from this a non-parallel course of the axis of rotation D is possible in relation to the leading edge 40 and/or the trailing edge 42 of the stabilizing surface 16. To provide an inflow nose 44 having a suitable, fluidically optimal profiling a first radius of curvature $R_1$ of the leading edge 40 is dimensioned significantly larger than a radius of curvature $R_2$ of the trailing edge 42.

A receiving pocket 50 in the hull 14 serves for preferably complete receiving of the stabilizing surface 16 when the stabilizing device 10 is inactive. In this case the stabilizing surface 16 is located in the so-called rest position wherein the axis of rotation D extends approximately parallel to the hull longitudinal axis 32.

A flow-edge-side inflow body 60 or filling body not co-rotating with respect to the axis of rotation D is disposed in the region of the drive journal 20; the inflow body 60 or filling body is oriented essentially parallel to the hull longitudinal axis 32. A cross-sectional geometry of the inflow body 60, not shown for the sake of a better drawing overview, essentially corresponds in a connecting region 62, at least with an angle of attack γ of approximately 0°, to an also not-shown cross-sectional geometry of the stabilizing surface 16.

A central plane 72 of the stabilizing surface 16 is defined by the leading edge 40 and the trailing edge 42. Here by way of example the angle of attack between the central plane 72 and the horizontal 70 is +γ.

As shown in FIG. 1, the stabilizing surface 16 is located in a first position 80, that is, the stabilizing surface 16 here is pivoted back about the pivot axis S by way of example as far as possible toward the stern 30 of the hull 14. Starting from the first position 80 the stabilizing surface 16 is pivoted by the positioning device 18 in a first pivot direction 82, here facing the bow 28, until the stabilizing surface 16 has assumed a central position 84 according to FIG. 2 and projects from the hull 14 approximately at right angles. Here by way of example the angle of attack +γ of the stabilizing surface 16 remains unchanged, but if required can also be changed using the positioning device 18. Due to the positive angle of attack +γ a hydrodynamic lifting force $F_{H1}$ acts on the pivoting stabilizing surface 16, which force $F_{H1}$ is oriented opposite the force of gravity $F_G$. Due to the hydrodynamic lifting force a (tilting) moment is caused about the hull longitudinal axis 32 of the ship 12, which (tilting) moment is used by the stabilizing device 10 for the greatest possible compensation of the rolling movements of the ship 12 occurring primarily about the hull longitudinal axis 32.

For this purpose the stabilizing device 10 includes a complex sensor system for detecting rolling-, pitching- and yawing-movement as well as the speed and further ship-relevant parameters in the water 26 in real time, on the basis of which a not-depicted efficient digital control- and/or regulating-device of the stabilizing device 10 controls the positioning device 16 such that in particular the undesirable rolling movements of the ship about the hull longitudinal axis 32 can be reduced as effectively as possible. Here a height of the hydrodynamic lifting force $F_{H1}$ varies with the pivot speed of the stabilizing surface 16 or the relative speed between the stabilizing surface 16 and the water 26, and the angle of attack γ.

FIG. 3 shows the stabilizing surface 16 in a second position 86 that is reached after a further pivoting of the stabilizing surface 16 by the pivoting device 18 about the pivot axis S by the angle +β toward the bow 28 or the first pivot direction 82.

According to the disclosure the leading edge 40 of the stabilizing surface 16 is always oriented independently of the respective current pivot and incidence angle β, preferably always essentially toward the inflowing water 26, whereby the positioning device 10 is particularly energy efficient. Starting from the second position according to FIG. 3, by moving further in the first pivot direction 82 the stabilizing surface 16 reaches the rest position of the stabilizing surface 16, wherein in the ideal case the stabilizing surface 16 is received completely in the receiving space and such that it is terminally flush with the hull 14. In the rest position there is thus no significant change of the hydrodynamic properties of the hull 14 and in particular no relevant increase of the flow resistance.

Figure 4:
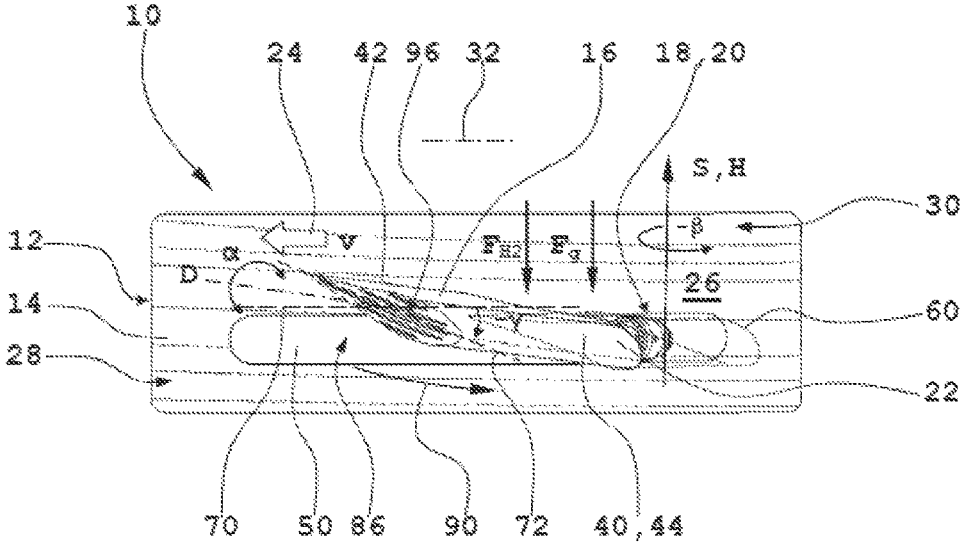
FIGS. 4-6 are perspective schematic views of the stabilizing surface of the stabilizing device of FIG. 1 in a second pivot direction, oriented opposite the first pivot direction of FIGS. 1 to 3, in each of three different positions.
Figure 5:
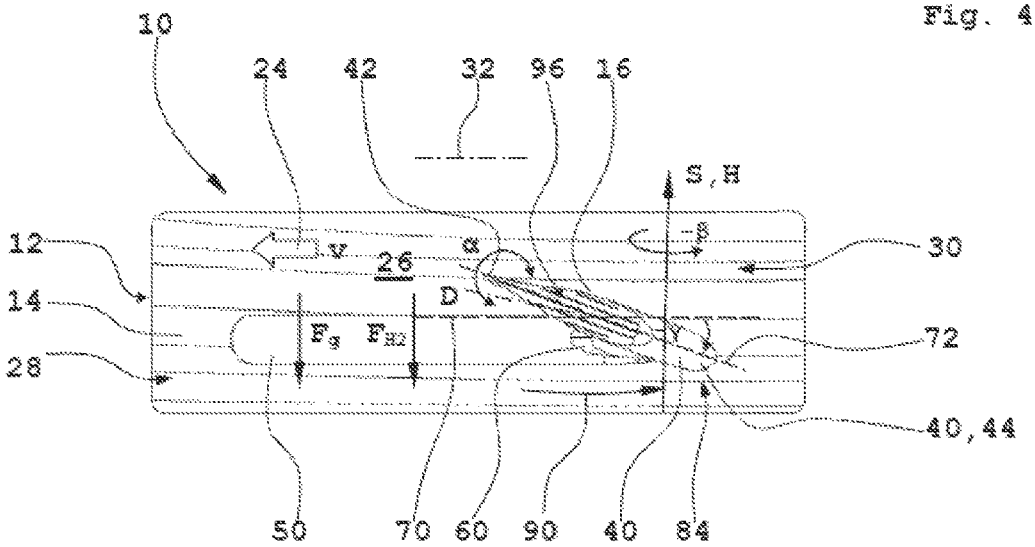
Figure 6:
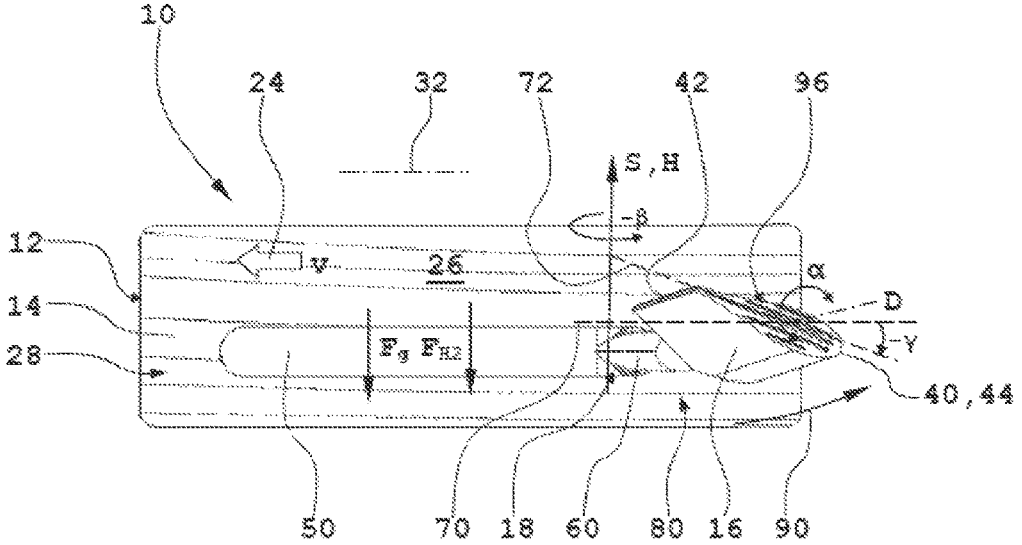

When the second position 86 is reached, using a positioning device 18 a reversal of the first pivot direction 82 is effected in a second pivot direction 90 that is oriented opposite to the first pivot direction 82, wherein the stabilizing surface 16 is preferably simultaneously rotated by approximately half a rotation or by an angle of rotation α of 180° about the axis of rotation D such that the stabilizing surface 16 assumes the further positions according to FIGS. 4 to 6. Varying from this, larger or smaller angles of rotation α of the stabilizing surface 16 about the axis of rotation D are also possible.

Here a free end surface 96 of the stabilizing surface 16 is provided by way of example with a rib structure oriented parallel to the center plane 72 and not shown for the sake of drawing clarity; the rib structure includes a plurality of parallel ribs for minimizing, in particular for reducing, turbulences and eddies.

FIGS. 4 to 6—which are referred to together in the further course of the description—illustrate a perspective view of the stabilizing surface of the stabilizing device in a second pivot direction, oriented opposite the first pivot direction according to FIGS. 1 to 3, in each of three different positions.

The hull 14 of the ship 12 is in turn moved through the water again in the direction of the white arrow 24. In FIG. 4 the stabilizing surface 16 of the stabilizing device 10 is still located in the second position 86. However, in contrast to the position of FIG. 3, the stabilizing surface 16 is rotated about its axis of rotation D by approximately half a rotation or 180°, such that during subsequent further pivoting of the stabilizing surface 16 the leading edge 40 is optimally flowed-against by the surrounding water 26. This makes possible a considerable reduction of the energy demand of the stabilizing device 10.

In addition, in contrast to FIGS. 1 to 3 there is, merely by way of example, an approximately constant angle of attack −γ here between the horizontal 70 and the central plane 72 of the stabilizing surface, whereby a hydrodynamic downthrust force $F_{H2}$ oriented in the direction of the force of gravity $F_G$ is generated by the stabilizing surface 16 and serves for damping rolling movements of the hull 14 of the ship 12 about the hull longitudinal axis 32. The level of the hydrodynamic downthrust force $F_{H2}$ is in turn dependent on the pivot speed of the stabilizing surface 16 or a relative speed resulting therefrom between the stabilizing surface and the water 26. Furthermore a speed v of the hull 14 of the ship 12 different from zero influences the downthrust force FH2 under certain circumstances. In the reversal points of the pivot movement of the stabilizing surface 16, that is, in the first and second position of the stabilizing surface 16, wherein preferably the rotation is also provided by the angle of rotation α of 180° or half the rotation about the axis of rotation D, the downthrust force $F_{H2}$ can consequently become small.

FIG. 5 illustrates the central position 84 of the stabilizing surface 16, wherein it is in turn oriented essentially at right angles to the hull 14 of the ship 12. Due to the further pivoting by the positioning device 18 of the stabilizing surface 16 toward the second pivot direction 90, the stabilizing surface 16 of the stabilizing device 10 ultimately reaches the first position 80 again according to FIG. 6.

In the further course of the description the inventive method shall be briefly explained, again with reference to FIGS. 1 to 6.

In a first method step a) with no heeling of the hull 14, the periodic pivoting of the at least one stabilizing surface 16, set at an angle of attack specified by a positioning device 18, is effected about the pivot axis S, essentially parallel to the force of gravity $F_G$ or the in the direction of the force of gravity, by the pivot angle of ±β up to reaching the first or the second position 80, 86. Here the central position 84 is cyclically traversed. With respect to the central position 84 of the stabilizing surface 16, the pivot angle β can be up to ±60°. A positive pivot angle +β defines a pivot movement about the pivot axis S in the clockwise direction, and a negative pivot angle −β a pivot movement about the pivot axis S in the counterclockwise direction, each as seen in plan view.

According to the method a change of the angle of attack γ of the stabilizing surface 16 can be effected in a range of up to ±60° with respect to the horizontal 70 in the course of the oscillating pivot movements about the pivot axis S in the two pivot directions 82, 90.

In a second method step b) during changing from the first to the second pivot direction 82, 90 and vice versa, i.e., in the respective reversal points of the pivot movement or when reaching one of the two positions 80, 86 of the stabilizing surface 16, a rotation of the stabilizing surface 16 is effected by the positioning device 18 by at least approximately half a rotation or by the angle of rotation α of 180° about the axis of rotation D of the stabilizing surface 16.

Consequently the inflow nose 44 of the leading edge 40 is always acted upon by the surrounding water 26, whereby the energetic efficiency of the stabilizing device 10 is significantly increased in active roll-damping operation.

According to FIGS. 1 to 6, according to the method, in active roll-damping operation the free end side 96 of the stabilizing surface 16, which free end side 96 is directed away from the drive journal 20 of the positioning device 18, follows a trajectory that approximately corresponds to a rectangle, or FIG. 8 on its side, or an infinity sign.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved active stabilizing devices and methods.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

10 Stabilizing device
12 Ship
14 Hull
16 Stabilizing surface
18 Positioning device
20 Drive journal
22 Root (stabilizing surface)
24 White arrow
26 Water
28 Bow
30 Stern
32 Hull longitudinal axis
40 Inflow edge
42 Outflow edge
44 Inflow nose
50 Receiving pocket
60 Inflow body
62 Connecting region
70 Horizontal
72 Central plane (stabilizing surface)
80 First position (stabilizing surface)
82 First pivot direction
84 Central position (stabilizing surface)
86 Second position (stabilizing surface)
90 Second pivot direction
96 Free end side (stabilizing surface)
FH1 Hydrodynamic lifting force
FH2 Hydrodynamic downthrust force
FG Gravitational force
H Vertical axis
D Axis of rotation
S Pivot axis
α Angle of rotation (stabilizing surface)
β Pivot angle (stabilizing surface)
γ Angle of attack (stabilizing surface)
R1 First radius of curvature
R2 Second radius of curvature
v Speed (watercraft, ship)

What is claimed is:

1. An active stabilizing device for a primary damping of rolling movements of a ship or other watercraft including a hull comprising:

at least one positioning device including a drive journal and a stabilizing fin having a stabilizing surface and a root, the drive journal being attached to the stabilizing fin at the root, the stabilizing surface having a leading edge and a trailing edge and being configured to be disposed underwater, wherein the positioning device is configured to set an angle of attack of the stabilizing fin by rotating the drive journal about a first axis of rotation and to pivot the drive journal about a second axis of rotation to move the stabilizing fin between a forward position and a rearward position relative to a bow of the ship or other watercraft.

2. The active stabilizing device according to claim 1, wherein the positioning device is configured to rotate the drive journal through an angle of about 180 degrees.

3. The active stabilizing device according to claim 2,
wherein a radius of curvature of the leading edge of the stabilizing fin is greater than a radius of curvature of the trailing edge of the stabilizing fin.

4. The active stabilizing device claim 2,
wherein the drive journal extends through an inflow body that does not rotate together with the stabilizing fin.

5. The active stabilizing device according to claim 4,
wherein the inflow body is fin-shaped and includes a leading edge facing in a direction of the bow.

6. The active stabilizing device according to claim 5,
wherein a cross-sectional geometry of the inflow body is substantially the same as a cross-sectional geometry of the stabilizing fin adjacent to the inflow body.

7. The active stabilizing device according to claim 1, wherein the positioning device is configured to pivot the drive journal so that the leading edge of the stabilizing fin extends in a longitudinal direction of the ship or other watercraft.

8. The active stabilizing device according to claim 1, wherein the second axis of rotation is substantially vertical.

9. A method for damping rolling movements of a ship or other watercraft including a hull and having a bow and a stern comprising;
providing at least one positioning device including a drive journal extending from the hull and a stabilizing fin having a stabilizing surface and a root, the drive journal being attached to the stabilizing fin at the root, the stabilizing surface having a leading edge and a trailing edge and being configured to be disposed underwater,
periodically pivoting the drive journal about a pivot axis to move the stabilizing fin in a forward direction toward the bow and to move the stabilizing fin in a rearward direction toward the stern, and
rotating the drive journal about a rotation axis so that the leading edge of the stabilizing fin faces in the forward direction when the stabilizing fin is moving in the forward direction and faces in the rearward direction when the stabilizing fin is moving in the rearward direction.

10. The method according to claim 9,
wherein pivoting the drive journal comprises pivoting the drive journal through an angle of about 120 degrees.

11. The method according to claim 10, wherein rotating the drive journal comprises rotating the drive journal through an angle of about 180 degrees.

12. The method according to claim 11,
including pivoting the drive journal to move the stabilizing fin to a rest position inside a receiving pocket in the hull of the ship or other watercraft.

* * * * *